US005171050A

United States Patent [19]

Mascotte

[11] Patent Number: 5,171,050

[45] Date of Patent: Dec. 15, 1992

[54] ADJUSTABLE STRIKE FOR DOOR-LOCKING AND DOOR-LATCHING MECHANISMS

[76] Inventor: Lawrence L. Mascotte, 9106 SE. 82nd, Portland, Oreg. 97266

[21] Appl. No.: 838,933

[22] Filed: Feb. 20, 1992

[51] Int. Cl.[5] ..... F05L 21/02

[52] U.S. Cl. ..... 292/341.18; 292/340; 49/395

[58] Field of Search ..... 292/340, 341.18, 341.19; 49/394, 395

[56] References Cited

U.S. PATENT DOCUMENTS

| | | | |
|---|---|---|---|
| 1,317,218 | 9/1919 | Plante | 292/341.18 |
| 1,793,115 | 2/1931 | Model | 292/341.18 |
| 1,913,444 | 6/1933 | Herdeg | 292/341.18 |
| 2,127,891 | 8/1938 | Starling | 292/341.18 |
| 2,412,497 | 12/1946 | Edwards | 292/341.18 |
| 2,486,772 | 11/1949 | Wuerl | 292/341.18 |
| 2,650,848 | 9/1953 | Garbs | 292/341.18 |
| 3,245,709 | 4/1966 | Rosenberger | 292/341.18 |
| 3,395,935 | 8/1968 | Rosenberger | 292/341.18 |
| 4,113,293 | 9/1978 | Paquette | 292/341.18 |
| 4,288,120 | 9/1981 | Moore | 292/341.18 |
| 4,630,396 | 12/1986 | Zvi | 49/395 |
| 4,867,496 | 9/1989 | Thomas | 292/341.18 |
| 5,118,151 | 6/1992 | Nicholas | 292/341.19 |

FOREIGN PATENT DOCUMENTS

| | | | |
|---|---|---|---|
| 180758 | 2/1907 | Fed. Rep. of Germany | 292/341.18 |
| 507017 | 6/1939 | United Kingdom | 292/341.18 |
| 2230294 | 10/1990 | United Kingdom | 292/341.18 |

*Primary Examiner*—Eric K. Nicholson
*Attorney, Agent, or Firm*—Adrian J. LaRue

[57] ABSTRACT

An adjustable device for door-locking and door-latching mechanisms of a door hingedly mounted onto a door frame that comprises a plate member having spaced openings mounted along an aperture of the door frame and secured thereto for receiving plungers of the door-locking and door-latching mechanisms to maintain the door in a closed and/or locked position. An adjustment member is located on the plate member adjacent at least the opening for receiving the plunger of the door-latching mechanism and being adjustable for engagement with such plunger to prevent play between the door and the door frame when the door is in a closed and latched position.

15 Claims, 6 Drawing Sheets

FIG. 1
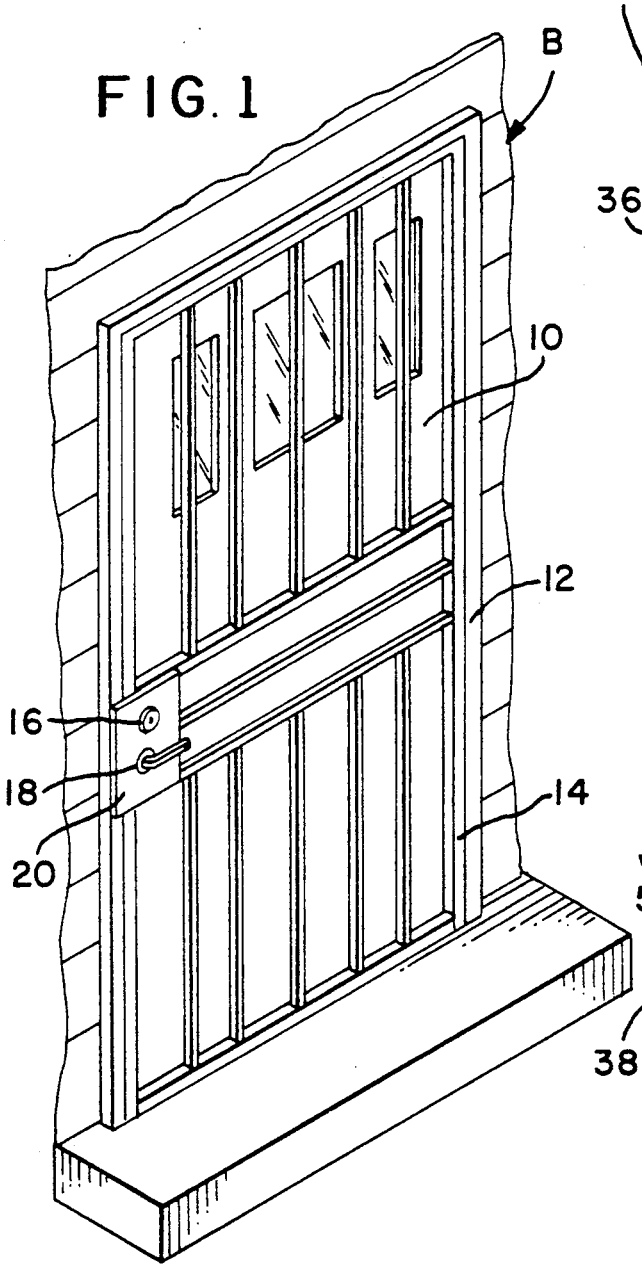
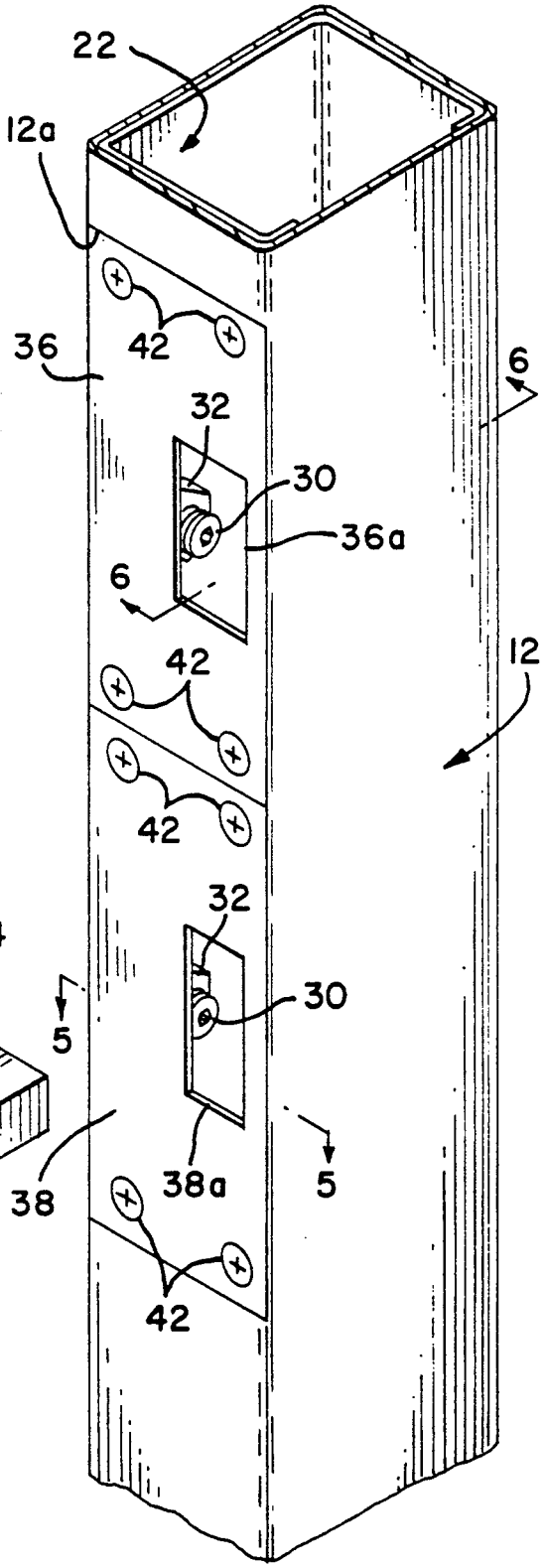
FIG. 4

ADJUSTABLE STRIKE FOR DOOR-LOCKING AND DOOR-LATCHING MECHANISMS

FIELD OF THE INVENTION

This invention relates to door-locking and door latch mechanisms and more particularly to door-locking and door-latching mechanisms that include adjustable members to prevent any play or rattle of the door when it is in a latched and/or locked position.

BACKGROUND OF THE INVENTION

When locking and latching plates are mounted on a door frame, this is usually done after the door has been hung. To locate these plates correctly so that they are in alignment with the locking and latching mechanisms on the door as well as being at the proper depth so that the door closes and latches tightly and does not rattle or have back and forth play is very difficult and most generally is impossible.

In the case of security doors as disclosed in U.S. Pat. No. 4,663,950, the metal door frame has proper size holes cut therein to receive the plungers of the lock and latch mechanisms. Even if the holes are cut correctly so that they are properly aligned with the lock and latch plungers when the door is installed, the door frame or door may settle or twist causing improper alignment between the holes and the plungers. The holes will then have to be recut or filed so that the plungers can be received in the holes but then the door will most likely rattle or have play between the door and door frame.

Another problem that occurs when a security door is installed is that the door handle of the security door may hit the door handle of the existing door thereby requiring the latch and lock mechanisms to be switched from top to bottom of the door frame of the security door. In doing this, the lock and latch have different back sets requiring the holes to be cut with a different back set which will most likely result in the door having play or rattle.

The object of this invention is to provide adjustable means as part of the latching and locking mechanisms of a door assembly to eliminate door play or rattle when the door is in a closed and/or locked position. Another object of the present invention is to enable switching the door-latching and door-locking mechanisms from the top to the bottom when necessary including adjustable means as part of the latching and locking mechanisms of the door assembly to eliminate door play or rattle.

SUMMARY OF THE INVENTION

According to one aspect of the present invention, a plate member having spaced openings is to be positioned in a tubular door frame with the openings communicating with an aperture in the door frame, plate means secured onto the plate member and having holes in communication with the openings in the plate member for receiving the plungers of the door-latching and door-locking mechanisms when the door is in a closed position, and adjustable means on the plate member for engagement with the door-latching and door-locking plungers to prevent door play or rattle.

According to another aspect of the present invention, a plate member having an aperture in a planar rectangular section is mounted onto a door frame with the aperture being in communication with a recess in the door frame, an inwardly-directed section of the rectangular section at a forward edge of the aperture that extends into the recess, and adjustment means on the inwardly-direction section and being adjustable for engagement with a plunger of a door-latching mechanism when the door is in a closed position in the door frame to prevent play between the door frame and the door.

BRIEF DESCRIPTION OF THE DRAWINGS

The invention is best understood by way of example with reference to the following detailed description thereof in conjunction with the accompanying drawings.

FIG. 1 is a part perspective view of a building including a door and a security door.

FIG. 4 is a view similar to FIG. 3 showing a completed assembly.

DETAILED DESCRIPTION OF THE INVENTION

Figure 2:
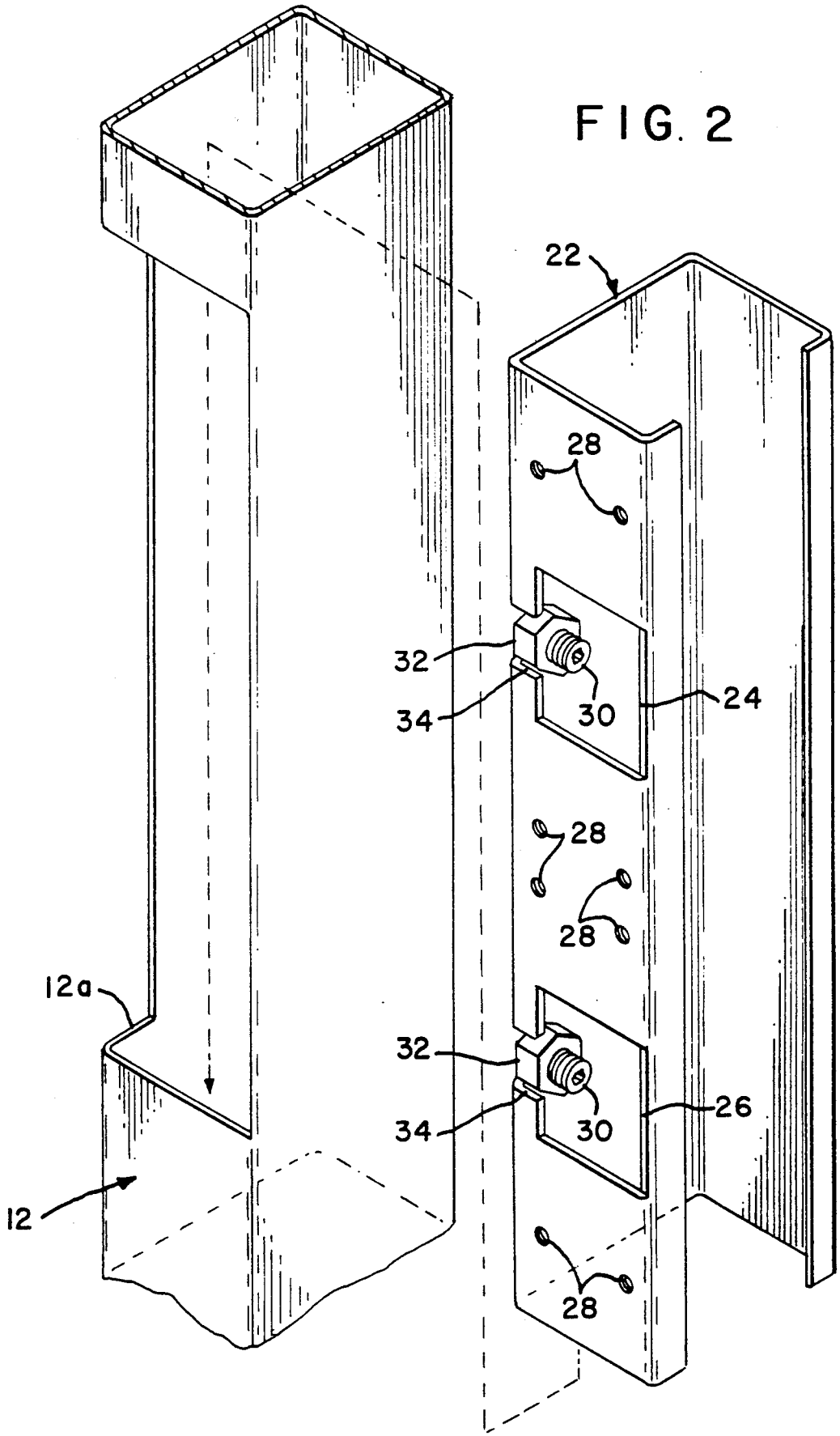
FIG. 2 is a part perspective view of the door frame and a plate member exploded therefrom.
Figure 3:
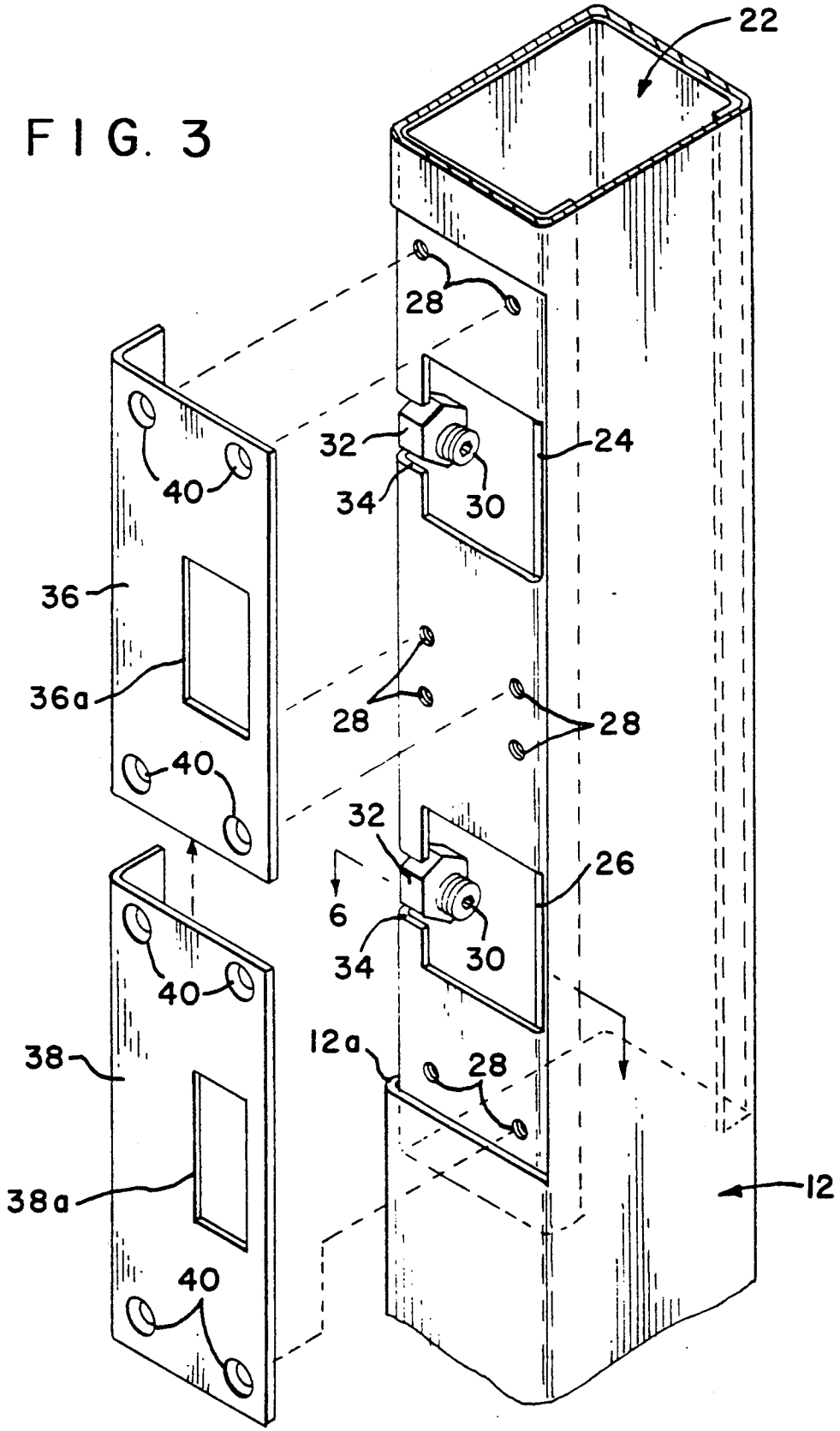
FIG. 3 is a view similar to FIG. 2 with door latching and locking plates exploded therefrom.

As shown in FIG. 1, a building B has an existing door 10 around the outside of which is secured a hollow metal frame 12 by hardened one way lag bolts (not shown) which extend through frame 12 and screw into the existing door frame thereby securing the metal frame 12 in position and prevents removal. A security door 14 is hingedly mounted onto frame 12 and is locked and latched in position therein by door-locking mechanism 16 and door-latching mechanism 18. Door 14 has a metal frame and can be used as a storm door in winter and screen door in spring, summer and fall. Door-latching mechanism 18 is conventional and has a handle and spring-biased plunger **18*a* (FIGS. 5,5A) to maintain door 14 closed; door-locking mechanism 16 is also of conventional construction and has a locking plunger to securely lock the door. A metal plate 20 is secured onto door 14 and engages frame 12** and covers the locking and latching plungers.

A metal plate member 22 as shown in FIGS. 2–8, is preferably in the form of a part-tubular shape but it can be of other desirable configurations. Plate member 22 is positioned within one side member of hollow metal frame 12 along aperture **12*a* thereof which is at the position of the door-latching and door-locking mechanisms 16,18. Plate member 22 has spaced openings 24,26 and pairs of threaded holes 28 above and below each opening 24,26. Set screws 30 are threadably mounted in hex nuts 32 which are secured in slots 34 of plate member 22 as by welding so that slots 34 are in communication with openings 24,26. This places set screws 30 just inside openings 24,26** and normal thereto.

Metal lock and latch plates 36,38 are L-shaped and have rectangular holes **36*a*, 38*a* along with pairs of beveled holes 40 which are in alignment with corresponding threaded holes 28 in plate member 22. Plates 36,38 are disposed in aperture 12*a* and screws 42 extend through holes 40 and threadably engage threaded holes 28 to maintain plate member 22 in position in metal frame 12 with the beveled heads of screws 42 being disposed in beveled holes 40 so that the screw heads are level with the outer surface of plates 36,38 as shown in FIG. 4. Also, the outer surfaces of plates 36,38 are level with the outer surface of frame 12. Holes 36*a*,38*a* are in communication with respective openings 24,26 of plate 22**.

Figure 5A:
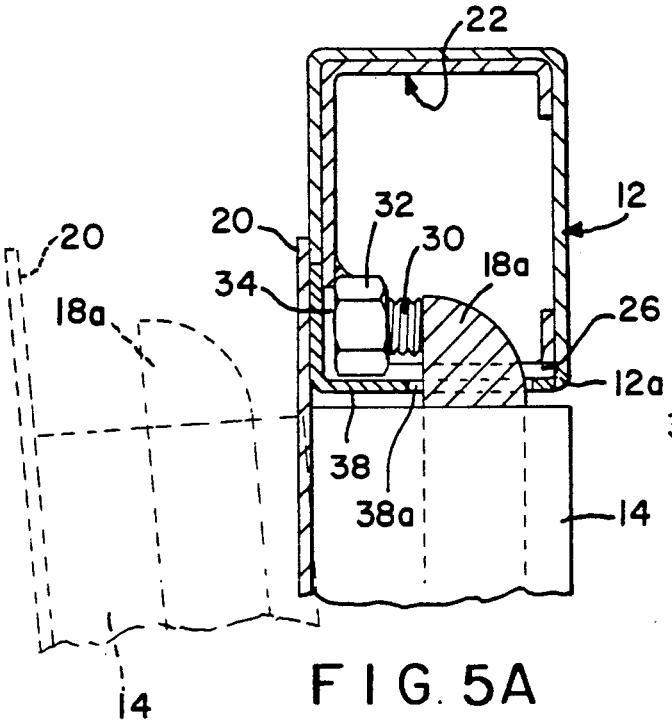
FIG. 5A is the same cross-sectional view as FIG. 5 showing the latch plunger in engagement with the adjustable means.
Figure 5:
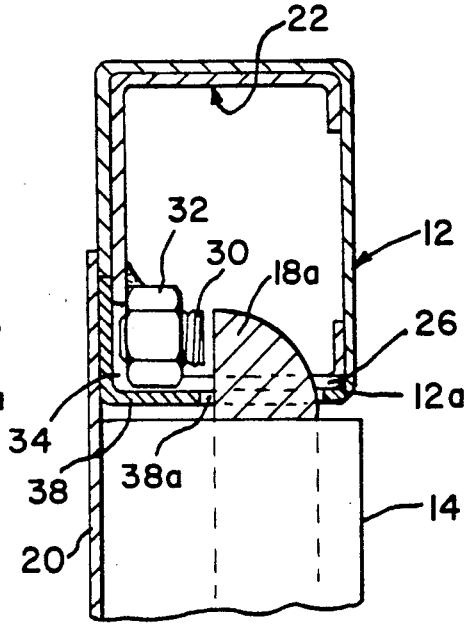
FIG. 5 is a cross-sectional view taken along line 5—5 of FIG. 4 showing the latch plunger in relation to the adjustable means.

With plate member 22 and plates 36,38 in position on frame 12 as shown in FIG. 5, door 14 is closed with metal plate 20 engaging frame 12 and plunger **18*a* disposed in aligned hole 38*a* and opening 26, door 14 can rattle or have play because plunger 18*a* has room to move therein. Door 14 is opened and an Allen wrench is applied to set screw 30 and moved to a position as shown in FIG. 5A so that when door 14 is closed, plunger 18*a* engages set screw 30 thereby eliminating rattle or play between door 14 and frame 12. The same operation is performed with regard to the plunger of lock mechanism 16 so that such plunger will engage set screw 30 in the same manner as plunger 18*a***.

Figure 6:
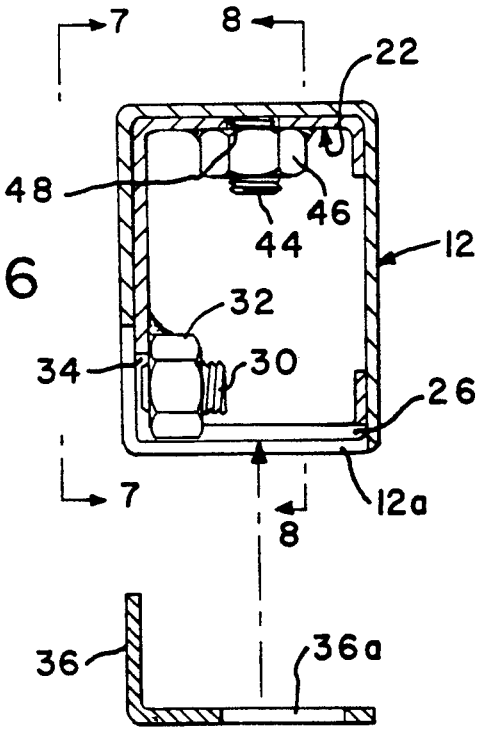
FIG. 6 is a cross-sectional view taken along line 6—6 of FIG. 8 showing an alternative embodiment with a lock plate exploded therefrom.
Figure 7:
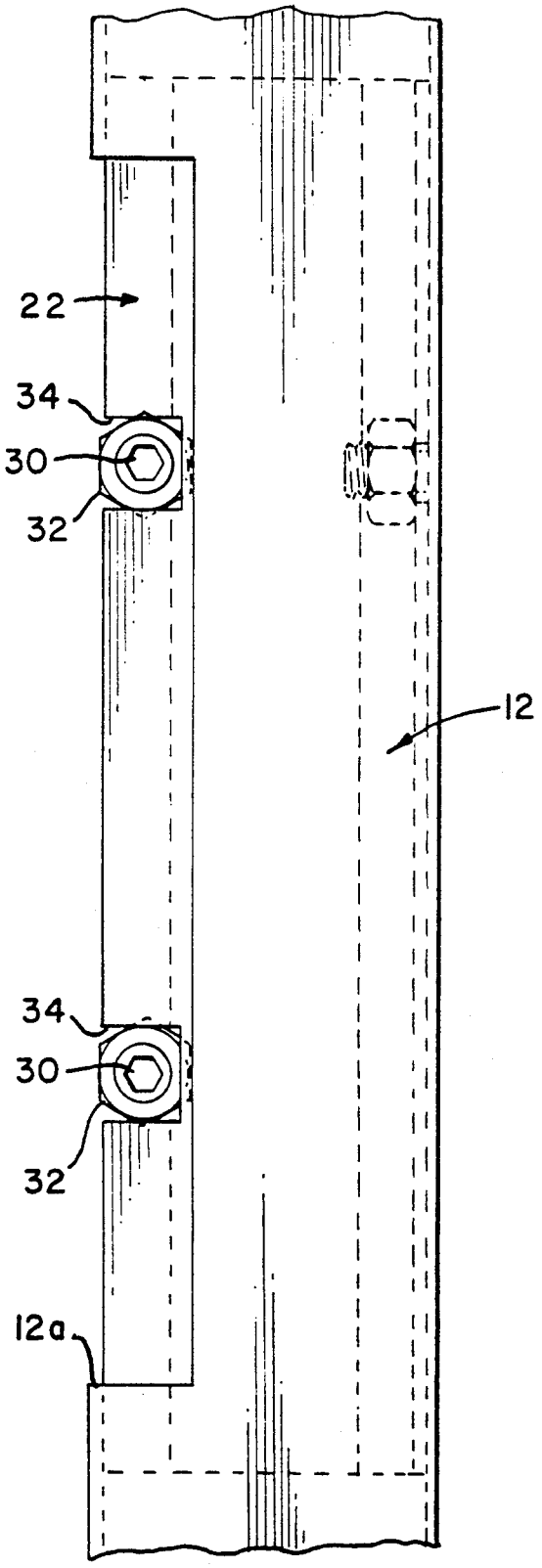
FIG. 7 and 8 are cross-sectional views taken along lines 7—7 and 8—8 of FIG. 6.
Figure 8:
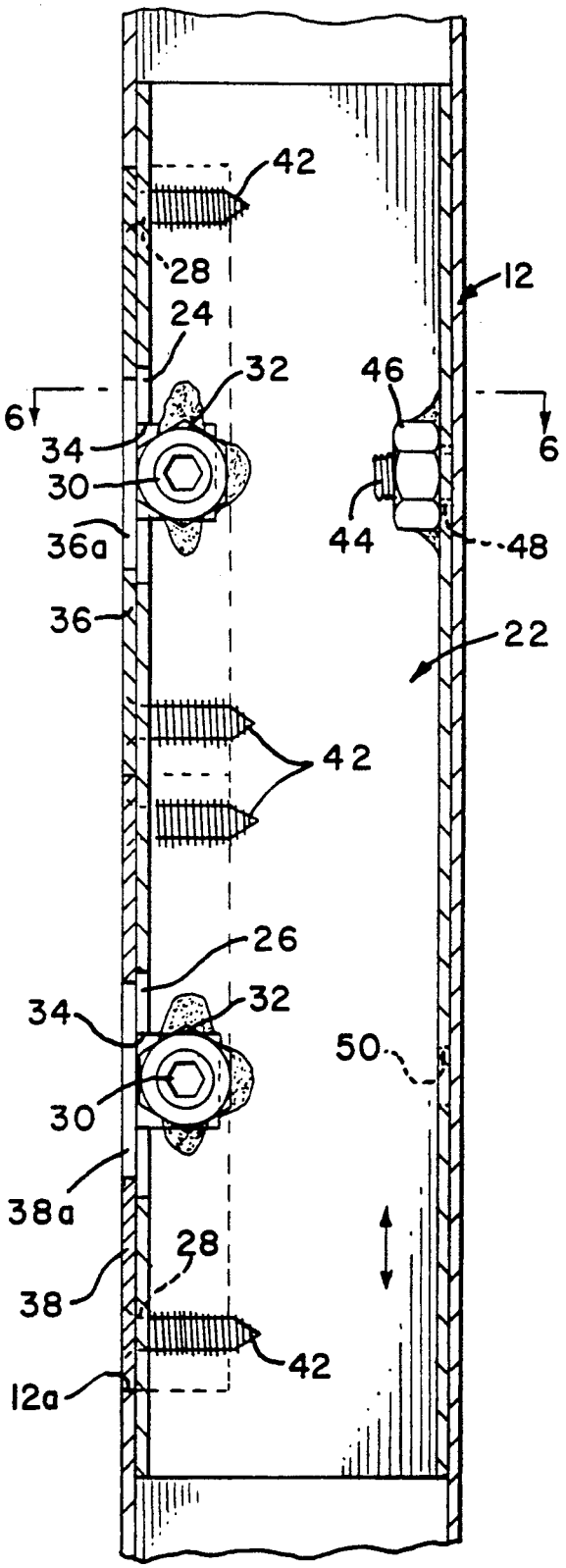

Another set screw 44 threadably disposed in hex nut 46 is secured as by welding to plate member 22 and located over a hole 48 in plate member 22 as shown in FIG. 6. Set screw 44 is moved through hole 48 into engagement with an inside surface of frame 12 via an Allen wrench through opening 24 thereby securing plate member 22 in position relative to aperture **12*a* within frame 12. Operation of set screw 44 enables vertical adjustment of plate member 22 within frame 12. If desired, another set screw and hex nut can be secured over hole 50 opposite set screw 30 and hex nut 32 and operated by an Allen wrench through opening 26**.

Whereas, set screw 30 and hex nut 32 are located adjacent openings 24,26 of plate member 22 for engagement with the plungers of the door-locking and door-latching mechanisms, a set screw and hex nut need only be used in conjunction with the plunger of the door-latching mechanism; however by using set screws and hex nuts for both the door-locking and door-latching mechanisms, play between the door and door frame will be eliminated if one of the set screws and hex nuts does not engage its respective plunger for some reason.

Figure 9:
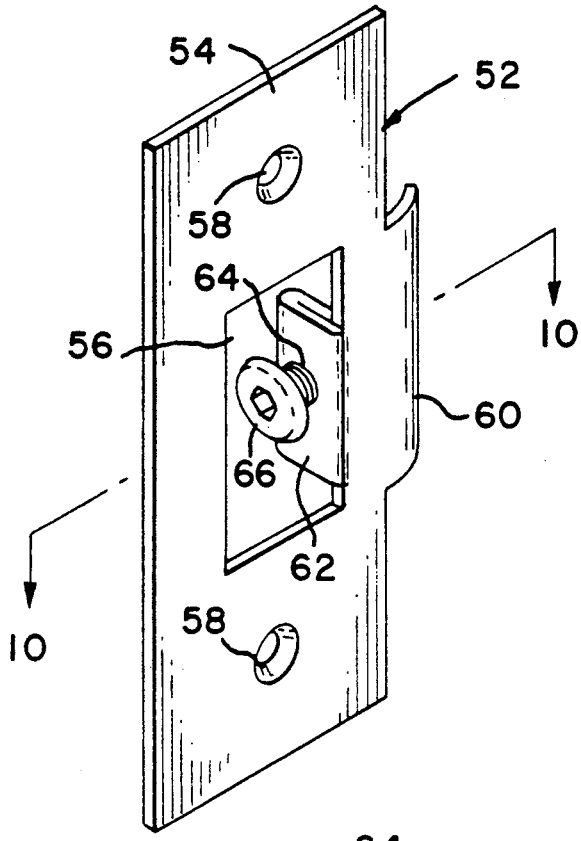
FIG. 9 is a perspective view of another alternative embodiment of the invention showing a latch plate including an adjustable screw thereon.
Figure 10:
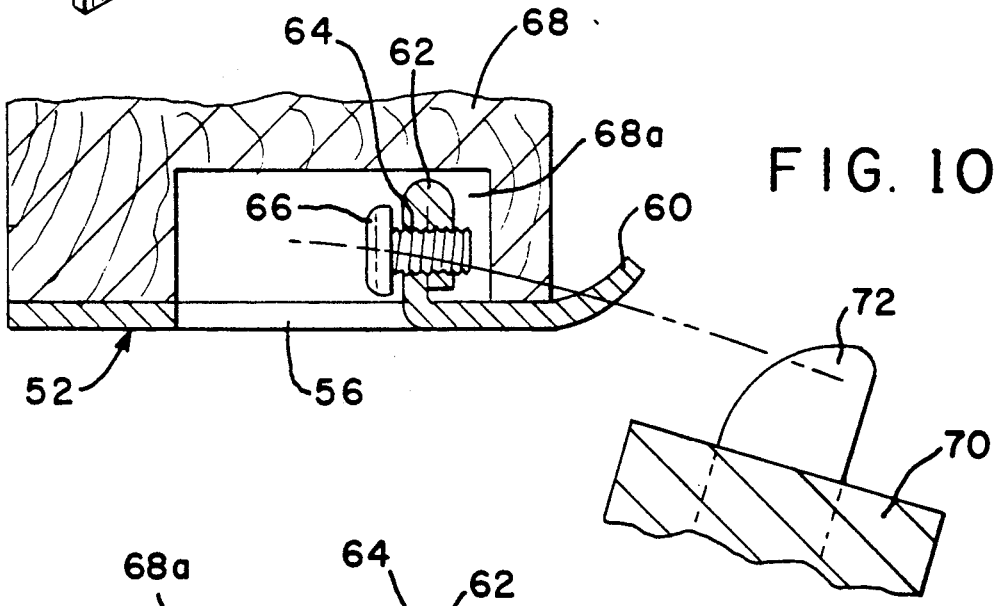
FIG. 10 is a cross-sectional view taken along line 1013 10 of FIG. 9 showing the latch plate mounted on a door frame with a part cross-sectional view of a door exploded therefrom.
Figure 11:
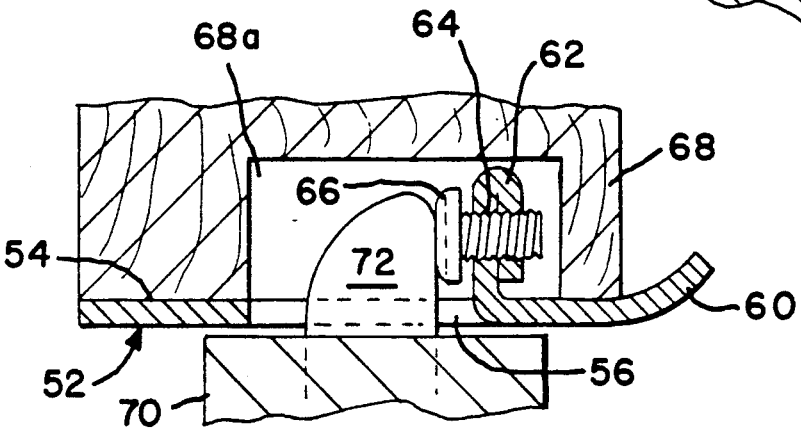
FIG. 11 is a view similar to FIG. 10 showing the door in a closed position.

FIGS. 9-11 show an alternative embodiment of the invention. A metal latch plate 52 has a planar rectangular section 54 that includes a rectangular aperture 56 and beveled holes 58 above and below aperture 56. An arcuate section 60 extends outwardly from planar section 54 in alignment with aperture 56. A folded section 62 at a forward edge of aperture 56 extends inwardly and is formed from the metal in forming aperture 56. A threaded hole 64 is provided in folded section 62 and a bolt 66 is threadably mounted therein.

Latch plate 52 is mounted on a door frame 68 via screws (not shown) that extend through holes 58 into the door frame. Aperture 56 is in communication with a recess **68*a* in door frame 68 and folded section 62 with screw 66 therein extends into recess 68*a* while arcuate section 60 extends slightly beyond the front surface of door frame 68**.

Door 70 is hingedly mounted to the door frame in a conventional manner (not shown) and has a spring-biased plunger 72 mounted therein as part of a conventional latch mechanism (not shown) mounted on the door. When door 70 is closed, plunger 72 engages arcuate section 60 of latch plate 52 biasing it inwardly until the door is at a closed position within door frame 68 whereupon plunger 72 moves into aperture 56 and recess **68*a* as shown in FIG. 11, and plunger 72 engages screw 66**.

If play exists between door 70 and door frame 68, screw 66 is adjusted so that engagement between plunger 72 and screw 66 precludes such play and door 70 fits tightly within door frame 68 thereby preventing any rattle and door 70 sealingly engages any sealing means in the door frame thereby assuring sealing of the door in the door frame.

As has been discerned, a plate member mounted along a door frame and having openings to receive plungers of the door-locking and door-latching mechanisms including adjustable plunger-engaging means to eliminate play or back-and-forth movement of the door within the door frame has been disclosed.

I claim:

1. An adjustable means for door-locking and door-latching mechanisms of a door hingedly mounted onto a door frame, comprising:

a plate member having spaced openings mountable along an aperture of the door frame for receiving plungers of the door-locking and door-latching mechanisms to maintain the door in a closed and/or locked position;

means for securing said plate member along the aperture of the door frame including a set screw threadably disposed in a nut secured onto the plate member over a hole therein so that the set screw can extend therethrough in engagement with the door frame; and adjustment means on said plate member adjacent at least the opening for receiving the plunger of the door-latching mechanism and being adjustable for engagement with the door-latching mechanism plunger to prevent play between the door and the door frame when the door is in the closed and latched position.

2. An adjustable means as claimed in claim 1, wherein said securing means includes plate means having holes in communication with said openings secured onto said plate member and being disposed along the aperture of the door frame.

3. An adjustable means as claimed in claim 1, wherein said adjustment means comprises a set screw threadably disposed in a nut secured onto said plate member.

4. An adjustable means as claimed in claim 1, wherein said adjustment means is adjacent both of said openings.

5. An adjustable means as claimed in claim 1, wherein said adjustment means includes a hex nut secured to said plate member and a set screw threadably disposed in said hex nut.

6. An adjustable means as claimed in claim 1, wherein said plate member has a part-tubular configuration.

7. An adjustable device for use within a tubular door frame along an aperture therein for door-locking and door-latching mechanisms of a door hingedly mounted onto the tubular door frame, comprising:

a plate member having spaced openings mountable within the tubular door frame along the aperture thereof for receiving plungers of the door-locking and door-latching mechanisms to maintain the door in a closed or locked position;

plate means having holes that are to be in communication with the openings in the plate member for extending along the aperture and securing said plate member in position along the aperture of the door frame; and adjustment means on said plate member adjacent at least the aligned opening and hole for receiving the plunger of the door-latching mechanism and including an adjustable member for adjustable engagement with the door-latching mechanism plunger to prevent play between the door and the door frame when the door is in the closed and latched position.

8. An adjustable device as claimed in claim 7, wherein said adjustment means includes a not secured onto said plate member with said adjustment member being a set screw threadably disposed in said nut.

9. An adjustable device as claimed in claim 7, wherein said adjustment means is adjacent both of said openings of said plate member.

10. An adjustable device as claimed in claim 7, wherein said securing means further includes a screw member threadably mounted onto said plate member for engagement with the tubular door frame prior to said plate means securing said plate member in position along the aperture.

11. A door frame for mounting onto an existing door frame of a building including a door hingedly mounted onto the door frame, comprising:

tubular door frame members with the tubular door frame member opposite the tubular door frame member to which the door is hingedly mounted having an aperture in alignment with door-locking and door-latching mechanism plungers of the door;

a plate member within the opposite tubular door frame member disposed along said aperture and having spaced openings;

a plate element extending along said aperture securing said plate member in position along said aperture and having spaced holes in communication with the spaced openings in the plate member so that the aligned holes and openings can receive the plungers of the door-locking and door-latching mechanisms to maintain the door in a closed or locked position; and an adjustment member on the plate member adjacent at least the aligned opening and hole for receiving the plunger of the door-latching mechanism for adjustable engagement with the door-latching mechanism plunger to prevent play between the door and the door frame when the door is in the closed and latched position.

12. A door frame as claimed in claim 11, wherein a securing member is located on said plate member for engagement with the opposite tubular door frame member to maintain said plate member in position along said aperture prior to said plate element being secured to said plate member.

13. A door frame as claimed in claim 11, wherein said adjustment member includes a screw threadably disposed in said plate member.

14. A door frame as claimed in claim 11, wherein said plate element includes two plate elements.

15. A door frame as claimed in claim 11, wherein said plate member is a part-tubular configuration.

* * * * *